US006582099B2

(12) United States Patent
Bartenbach

(10) Patent No.: US 6,582,099 B2
(45) Date of Patent: Jun. 24, 2003

(54) LUMINAIRE FOR ELONGATE LAMP

(75) Inventor: Christian Bartenbach, Aldrans (AT)

(73) Assignee: Gebr. Ludwig GmbH, Mering (DE)

( * ) Notice: Subject to any disclaimer, the term of this patent is extended or adjusted under 35 U.S.C. 154(b) by 0 days.

(21) Appl. No.: 09/748,465

(22) Filed: Dec. 26, 2000

(65) Prior Publication Data

US 2001/0019481 A1 Sep. 6, 2001

(30) Foreign Application Priority Data

Dec. 27, 1999 (AT) ..... 2190/99

(51) Int. Cl.[7] ..... F21V 11/06

(52) U.S. Cl. ..... 362/291; 362/290; 362/342; 362/217

(58) Field of Search ..... 362/290, 291, 362/342, 217, 354, 147

(56) References Cited

U.S. PATENT DOCUMENTS 5,528,478 A * 6/1996 Degelmann ..... 362/291
5,758,954 A * 6/1998 Holten et al. ..... 362/291
5,944,411 A * 8/1999 Holten et al. ..... 362/291

FOREIGN PATENT DOCUMENTS

| | | |
|---|---|---|
| DE | 4417917 A1 | 12/1995 |
| DE | 29602357 | 5/1996 |
| EP | 0138747 | 4/1985 |
| EP | 0435394 | 7/1991 |
| EP | 0435394 B1 | 12/1994 |
| GB | 2341669 | 3/2000 |

* cited by examiner

*Primary Examiner*—Thomas M. Sember

(57) ABSTRACT

A luminaire for an elongate lamp has longitudinal reflectors running parallel to the lamp and a multiplicity of spaced-apart transverse lamellae. The lamellae have a bottom, tapering region with a bottom edge that is curved. The cross-section of the bottom, tapering region is of the same shape over the width of the transverse lamellae. The edges of the bottom tapering region have the same curvature, with the lower edge coinciding with the bottom edge of the transverse lamellae.

11 Claims, 2 Drawing Sheets

LUMINAIRE FOR ELONGATE LAMP

BACKGROUND OF THE INVENTION

The present invention relates to a luminaire for an elongate lamp, having longitudinal reflectors running parallel to the lamp and having a multiplicity of spaced-apart transverse lamellae which have a bottom, tapering region and of which the bottom edge is curved.

Such a luminaire is known from U.S. Pat. No. 5,758,954. The bottom, tapering region of the transverse lamellae here has a changing curvature since the bottom edge of the transverse lamellae is curved, whereas the edges which bound the bottom, tapering region in the upward direction are of rectilinear design. This geometry has an adverse effect on the lighting distribution.

SUMMARY OF THE INVENTION

The object of the invention is thus to improve the lighting distribution of the known luminaire.

This is achieved according to the invention in that the cross section of the bottom, tapering region is of the same shape over the width of the transverse lamellae, and in that the edges which bound the bottom, tapering region in the upward direction coincide, in terms of curvature, with the bottom edge of the transverse lamellae.

The three-dimensional shaping of the bottom region of the transverse lamellae is produced, from a geometrical point of view, in that a predetermined segment of a curve, which is preferably curved parabolically, is displaced in a plane normal to the longitudinal axis of the lamp, with constant alignment, along the curved bottom edge of the transverse lamellae. The highest point here is located in the center of the transverse lamellae, whereas the bottom edge slopes down in the direction of the borders of the transverse lamellae. The cross sections through the transverse lamellae are of the same shape and are merely offset in height in relation to one another. Overall, the new lamellae shape makes it possible to achieve, even with elongate light sources, for example fluorescent tubes, an essentially rotationally symmetrical light distribution and screen behavior.

It is particularly straightforward from a design point of view if the top region of the transverse lamellae, said top region being located above the edges, is of a constant thickness. It is favorable here from a lighting point of view if the thickness of the transverse lamellae is approximately half the diameter of the lamp.

Excess limiting of the radiation in the longitudinal direction of the luminaire can be avoided in that the vertical height difference of the bottom edge of the transverse lamellae is approximately a quarter of the diameter of the lamp.

In order to provide a free space for the lamp, finally, it is preferably provided that the top surface of the transverse lamellae, as seen in the longitudinal direction of the lamp, is indented in the form of a V in the central region.

BRIEF DESCRIPTION OF THE DRAWINGS

Further features and details of the present invention can be gathered from the following description of the figures, in which.

DETAILED DESCRIPTION OF THE PREFERRED EMBODIMENTS

The luminaire according to the invention has, as its light source, an elongate lamp 1. Extending parallel to said lamp 1 are longitudinal reflectors 2 which are designed symmetrically in relation to the longitudinal center plane.

Figure 1:
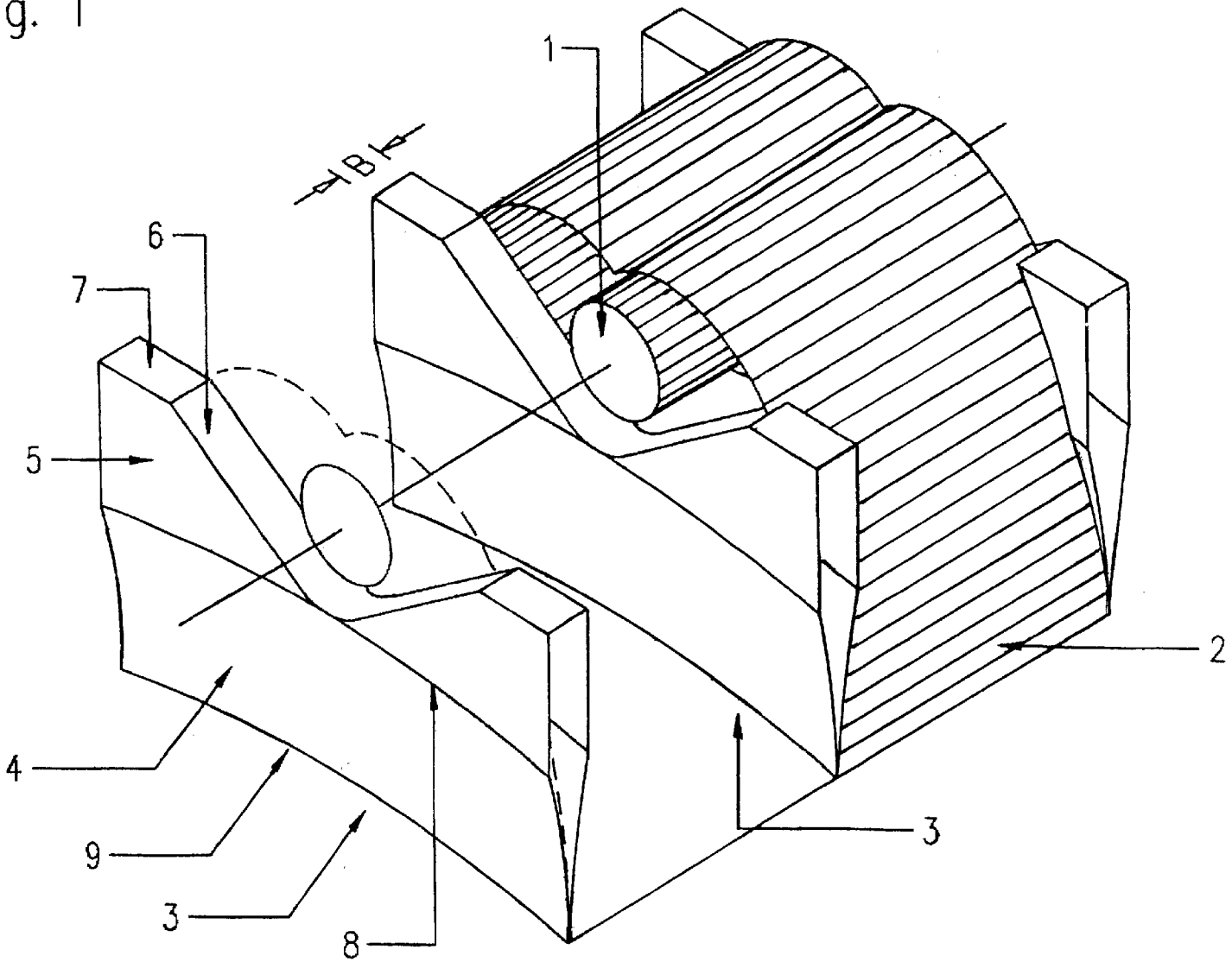
FIG. 1 shows a perspective view of a luminaire according to the invention.

In FIG. 1, the longitudinal reflectors 2 are depicted merely in the region between two transverse lamellae 3, but they extend over the entire luminaire. In the top region, the elongate reflectors 2 are in involute form, with the result that all the impinging rays are reflected downward past the lamp 1.

A plurality of lamellae 3 are arranged at regular intervals transverse to the longitudinal axis of the lamp 1. The plurality of lamellae 3 are produced from high-grade aluminum sheet material.

Figure 2:
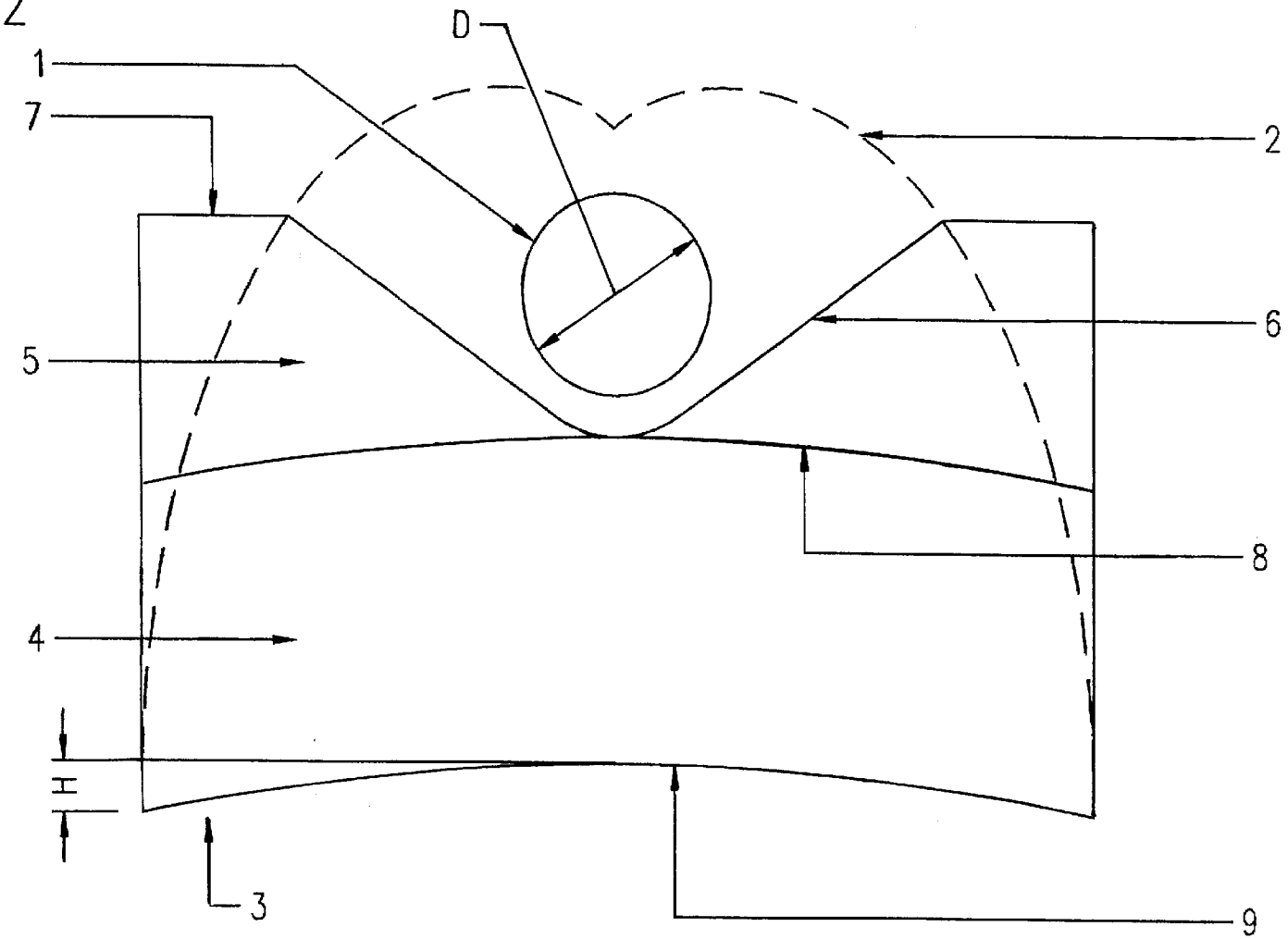
FIG. 2 shows a front view of a transverse lamella.

In the bottom region 4, between a concavely curved free edge 9 and a curved upper border 8, which bound the bottom region 4 in the upward direction, the plurality of lamellae 3 taper conically, the surfaces being curved concavely. In specific terms, the curvature is parabolic or the like and is produced by transverse displacements along the free edge. 9. The transverse displacement takes place in a plane normal to the center axis of the lamp 1, the alignment of the parabolic curved segment which is displaced transversely remaining unchanged. In this way, the curvature of the free edge 9 coincides with the curvature of the upper border 8. The vertical height difference H depicted in FIG. 2 is a quarter of the diameter D of the lamp 1.

In the region 5 above the upper border 8, the side surfaces of the plurality of lamellae 3 run parallel to one another, this resulting in an unchanged thickness B in the top region 5 of the plurality of lamellae 3. This thickness B is around half the diameter D of the lamp 1.

The top surface 6 of the plurality of lamellae 3, outside the longitudinal reflector, runs horizontally in the border zones 7 and, in the longitudinal reflector, is indented in the form of a V in the direction of the center, this resulting in a free space for the lamp 1. In this case, the indent reaches downwards essentially as far as the upper border 8.

What is claimed is:

1. A luminaire for an elongate lamp with a long axis, comprising:

reflectors arranged parallel to the long axis of the lamp for reflecting light from the lamp;

a plurality of lamellae arranged traverse to the long axis of the lamp to distribute light from the lamp, at least one of the lamellae having a first tapered surface tapering in a direction away from the long axis of the lamp and extending along the at least one lamella transverse to the long axis, the first tapered surface tapering to a concavely curved free edge of the at least one lamella, which is curved around an axis parallel to the long axis; and the first tapered surface having a curved upper border spaced from the free edge of the at least one lamella, wherein the upper border and the free edge have a curvature that is the same, such that a cross-section of the first tapered surface taken parallel to the long axis of the limp is the same size and shape everywhere along the length of the at least one lamella in a direction transverse to the long axis.

2. The luminaire according to claim 1, further comprising a second tapered surface on the at least one lamella on an opposite side of the at least one lamella from the first tapered surface and of the same size and shape as the first tapered surface, such that the first and second tapered surfaces form a concave tapered section of the at least one lamella.

3. The luminaire according to claim 2, wherein the concave tapered section has a cross-section that is constant along the length of the at least one lamella.

4. The luminaire according to claim 2, wherein the second tapered surface has a free edge that coincides with the free edge of the first tapered surface.

5. The luminaire according to claim 1, wherein the curvatures of the upper border and the free edge are parabolic.

6. The luminaire according to claim 1, further comprising a constant thickness portion of the at least one lamella located adjacent the first tapered surface and at the upper border and being closer to the lamp than the first tapered surface.

7. The luminaire according to claim 6, wherein the lamp has a diameter passing through the long axis, and the thickness of the portion along the long axis of the at least one lamella is approximately half of the lamp diameter.

8. The luminaire according to claim 1, wherein the curvatures of the upper border and the free edge are circular.

9. The luminaire according to claim 1, wherein the lamp has a diameter passing through the long axis, and the concavely curved free edge of the at least one lamella rises to a depth of approximately a quarter of the lamp diameter.

10. The luminaire according to claim 1, wherein:

the at least one lamella has a surface opposite the free edge, and the surface has a central region and end regions along the length of the at least one lamella;

the central region of the surface facing the lamp and being indented in a V-shape away from the lamp; and the end regions of the surface lie substantially in a plane that does not intersect the long axis.

11. A lamella for a luminaire housing an elongate lamp with a long axis, the lamella being arranged transversely to the long axis and comprising:

a first tapered surface tapering in a direction away from the long axis of the lamp and extending along the lamella transverse to the long axis, the first tapered surface tapering to a concavely curved free edge of the lamella, which is curved around an axis parallel to the long axis; and the first tapered surface having a curved upper border spaced from the free edge of the lamella, wherein the upper border and the free edge have a curvature that is the same, such that a cross-section of the first tapered surface taken parallel to the long axis of the lamp is the same size and shape everywhere along the length of the lamella transverse to the long axis.

* * * * *